US008579719B2

(12) United States Patent
Mabrey

(10) Patent No.: US 8,579,719 B2
(45) Date of Patent: Nov. 12, 2013

(54) GOLF TRAINING AID

(76) Inventor: Robert A. Mabrey, Englewood, FL (US)

( * ) Notice: Subject to any disclaimer, the term of this patent is extended or adjusted under 35 U.S.C. 154(b) by 0 days.

(21) Appl. No.: 13/353,576

(22) Filed: Jan. 19, 2012

(65) Prior Publication Data

US 2013/0190101 A1 Jul. 25, 2013

(51) Int. Cl.
*A63B 69/36* (2006.01)
*A63B 57/00* (2006.01)

(52) U.S. Cl.
USPC ..... 473/257; 473/218; 473/398

(58) Field of Classification Search
USPC ..... 473/257, 266, 268, 387, 389, 400, 407, 473/398
See application file for complete search history.

(56) References Cited

U.S. PATENT DOCUMENTS 1,596,110 A 8/1926 Lynch
2,119,044 A * 5/1938 Davids ..... 473/257
2,652,251 A * 9/1953 Molinar ..... 473/218
3,347,551 A * 10/1967 Dreyfus ..... 473/257
3,899,179 A * 8/1975 Vlach ..... 473/218
3,920,248 A * 11/1975 Medders ..... 473/218
4,128,245 A 12/1978 Vlach
5,240,254 A * 8/1993 Adlam ..... 473/257
5,398,937 A * 3/1995 Regan ..... 473/257
5,738,598 A 4/1998 Wu
5,893,805 A * 4/1999 Douglass ..... 473/218
D431,849 S 10/2000 MacDonald
6,514,151 B2 2/2003 Delaplane
6,949,029 B1 * 9/2005 Strande ..... 473/257
7,874,930 B2 * 1/2011 Hubley ..... 473/257
7,914,398 B2 3/2011 Tuck et al.
2005/0233837 A1 * 10/2005 Jung ..... 473/386
2008/0020868 A1 * 1/2008 Palmer ..... 473/409
2009/0176595 A1 * 7/2009 Hubley ..... 473/238

* cited by examiner

*Primary Examiner* — Nini Legesse
(74) *Attorney, Agent, or Firm* — Gifford, Krass, Sprinkle, Anderson & Citkowski, P.C.

(57) ABSTRACT

A golf swing training aid in the form of a modified golf tee including an indicator for indicating the target line from the tee to the target and a second indicator for indicating the preferred swing path of a golf club for moving the ball toward the target line and in the direction of the target.

8 Claims, 1 Drawing Sheet

GOLF TRAINING AID

FIELD OF THE INVENTION

The present invention relates to a golf swing training aid and more particularly to a modified golf tee provided with indicators to indicate a preferred swing path in relation to a target line.

BACKGROUND OF THE INVENTION

There are many different devices useful in the instruction of the proper golf stance and golf swing. Generally such devices have been in the form of means insuring that a proper stance is achieved. Heretofore such devices have not generally included means to teach a proper swing and where they have the concentration has been on a swing generally parallel to the line of the golfer's stance.

SUMMARY OF THE INVENTION

The present invention includes a golf swing training aid in the form of a modified golf tee having a first indicator to indicate the direction of the target line and a second indicator, which indicates a preferred swing path. Applicant has found that a proper swing path for driving a golf ball along a target path is between 20 and 30 degrees from the target line. The modified tee of the present invention includes a first indicator, which indicates the direction of the target line, and a second indicator located in a clockwise direction from the first indicator, having an angle of between 20 and 30 degrees which defines the direction of the swing path of a right hand golfer. The training aid of the present invention can be used by an instructor to teach a proper golf swing for hitting the golf ball toward the target and after its use is demonstrated and explained it can be used by the golfer away from the instructor for practice.

BRIEF DESCRIPTION OF THE DRAWINGS

The golf swing training aid of the present invention is illustrated in the attached drawing in which.

DETAILED DESCRIPTION OF THE PREFERRED EMBODIMENTS

Figure 2:
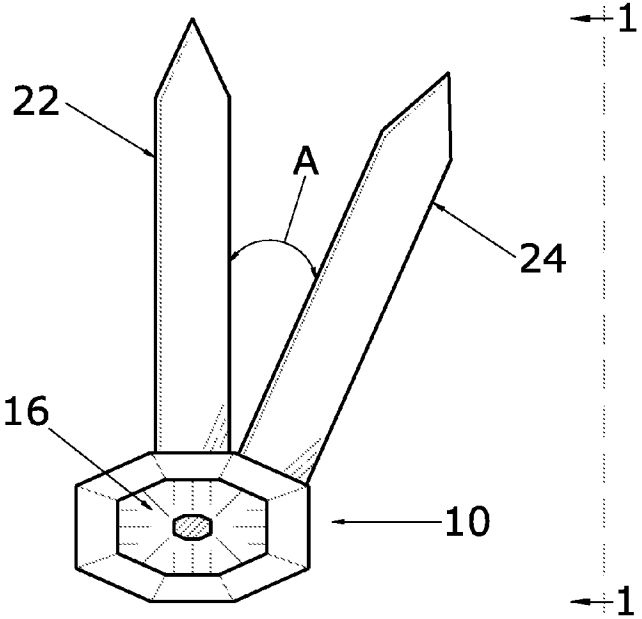
FIG. 2 is a top elevational view of the modified golf tee illustrated in FIG. 1.
Figure 1:
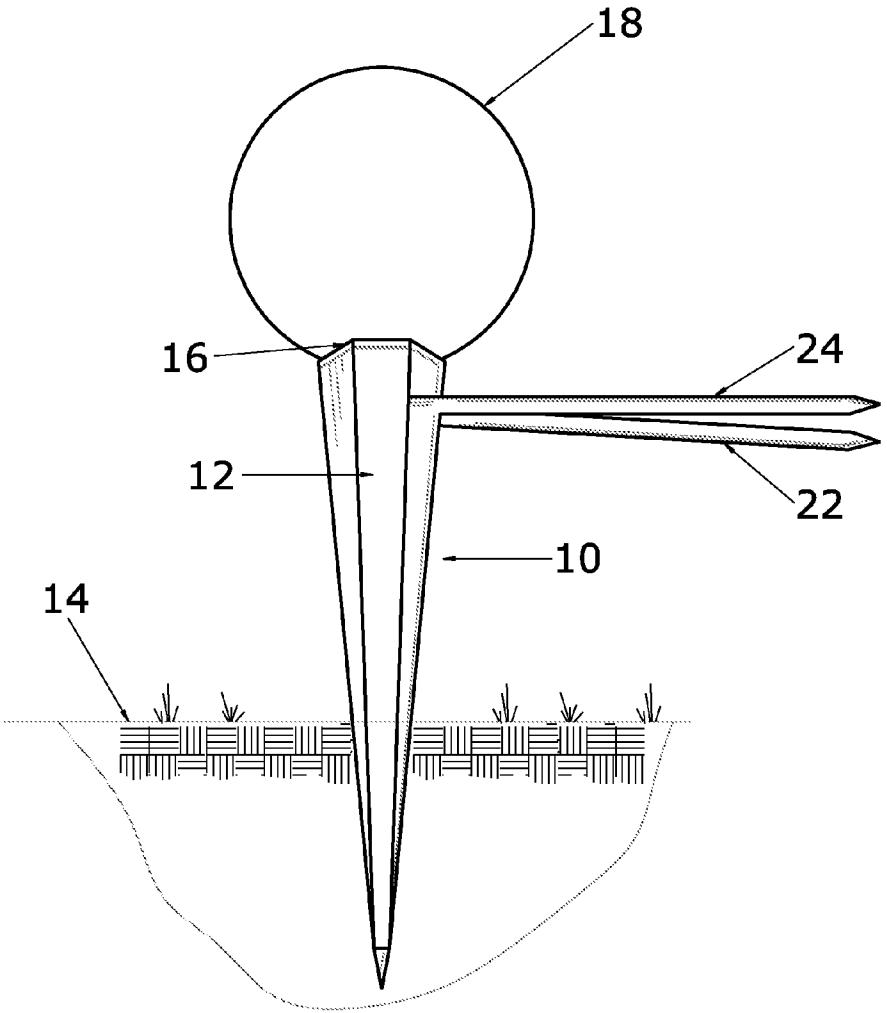
FIG. 1 is a side elevational view of the modified golf tee of the present invention substantially as seen from Line 1-1 of FIG. 2.

The golf swing training aid of the present invention comprises a modified golf tee 10 which includes a pointed shank 12 intended to be inserted into the ground 14 and an upper concave depression 16 for receiving and holding a golf ball 18 at a point above the ground 14. Pointed indicators 22 and 24 extend outwardly from the tee 10 parallel to the ground 14.

As best seen in FIG. 2, the indicators 22 and 24 are preferably spaced to form an angle A between them of 20 to 30 degrees with 22 to 27 degrees being the preferred range. The tee 10 is placed in the ground 14 with the indicator 22 pointing in the direction of the target (not shown). The indicator 24 will preferably be 22-27 degrees from the indicator 22 in a clockwise direction for a right hand golfer.

For a left hand golfer, the indicator 24 will indicate the target line and the indicator 22 will indicate the swing path and will be 22-27 degrees in a counterclockwise position from the indicator 24.

The golf swing training aid in the form of the modified golf tee 10 of the present invention has been designed to allow the golfer, whether a novice, amateur, advanced or professional, the ability to learn and/or advance their individual golfing skills. One indictor 22 or 24 indicates the target line and the other depicts the preferred swing path of the golf club. The swing path of the golf club is also referred to as the direction of momentum which is generated from the body.

There are a multitude of reasons as to why a person addresses the golf ball the way they do i.e., height, weight, stature, physical ability and/or the lack of, gender, etc, Although there are several variations in the manner each individual may attempt to address the golf ball, it is best accomplished when the address position which the golfer assumes provides for a stance that is parallel to the intended target line. Indicator 22 of the modified tee 10 aids a right handed golfer in taking the proper stance.

When the golfer takes the address position or stance to the golf ball it is extremely beneficial that this position be parallel to the target line. As described the direction indicated directly across from the golfer to the golf ball is best defined in mathematical terms as being perpendicular or 90 degrees to the target line. Therefore the parallel direction and perpendicular direction combined make up a total of 90 degrees. In order for two parallel lines to converge, which is necessary if the swing path is going to result in the ball eventually moving along the target line, there must be a forward approach angle greater than zero but no more than 90 degrees.

Applicant, thorough research and experience, has learned that the optimal swing path lies between the angles of 22 to 27 degrees from the target line when the test subjects are near an average height of 5'10". Other factors that attribute to the preferred swing path angle for individual golfers are mobility and range of motion. One aspect not to be overlooked is visual acuity. For this reason, the optimal swing path for an individual may be between 20 and 30 degrees. It has been found, however, that the optimal swing path for most golfers is between 22 and 27 degrees.

As described, the best possible scenario for a golf ball to take flight directly down a target line would be to have the golf club face approach the golf ball with a square face angle from 6 inches behind and 6 inches through the golf ball, considered the impact area. This training aid of the present invention provides for the multitude of instructions unique to the golf swing while at the same time maintaining simplicity.

The golfer positions himself parallel to the target line, creating a stance and then moves the golf club down the swing path line with forward momentum on the indicated angle outward which allows the golf ball to fly forward and down the target line allowing for a complete, accurate and repeatable golf swing. Additionally, this training aid can be utilized with a golfer that is either left or right handed.

It should be apparent that the golf swing training aid of the present invention, in the form of the illustrated modified golf tee, could be in the more common form of golf tees with the indicators provided in the form shown or other forms. All that is necessary is that one indicator be capable of indicating the direction of the target line, that is the line from the tee to the target, and the other indicator be positioned to indicate the proposed swing path with the second indicator spaced between 20 and 30 degrees from the first indicator.

It is apparent that other changes and modifications can be made to the golf swing training aid which is shown and illustrated without departing from the scope the present invention.

I claim:

1. A golf swing training aid comprising:

a golf tee having a shank to be inserted in the ground and a ball receiving portion to support a golf ball in a position above the ground;

a first and a second indicator constructed integrally with and extending substantially horizontally from the shank of the golf tee proximate the ball receiving portion, the first indicator indicating an intended target line and the second indicator indicating a preferred swing path of a golfer utilizing the golf tee; and said second indicator being spaced from the first indicator and being positioned in a clockwise direction from said first indicator at an included angle of between 20 and 30 degrees.

2. The golf swing training aid as defined in claim 1 and in which the included angle between said first indicator and said second indicator is between 22 and 27 degrees.

3. The golf swing training aid of claim 1, wherein said shank comprises a plurality of side surfaces and the first and the second indicator each extend from a different side surface of said shank.

4. The golf swing train aid of claim 3, wherein the shank comprises eight side surfaces.

5. A golf swing training aid comprising;

a golf tee having a shank to be inserted in the ground and a ball receiving portion to support a golf ball in a position above the ground;

a first indicator and a second indicator constructed integrally with and extending substantially horizontally from the shank of the golf tee proximate the ball receiving portion, the first indicator indicating a preferred swing path for a golfer utilizing the golf tee and a second indicator indicating an intended target line; and said second indicator being spaced from the first indicator and being positioned in a clockwise direction from said first indicator at an included angle of between 20 and 30 degrees.

6. The golf swing training aid as defined in claim 5 and in which the included angle between said first indicator and said second indicator is between 22 and 27 degrees.

7. An apparatus consisting of:

a one-piece golf tee including a pointed shank, a ball receiving portion, and a first and a second indicator, the pointed shank being insertable into the ground, the ball receiving portion being positioned at one end of the pointed shank and having a concave depression, and the first indicator and the second indicator extending substantially horizontally from the pointed shank proximate the ball receiving portion, with the second indicator being space from the first indicator and fixed at an angle relative to the first indicator of between 20 and 30 degrees.

8. The apparatus of claim 7, wherein the first and second indicator extend from the pointed shank in substantially the same horizontal plane.

* * * * *